US007736172B2

(12) United States Patent
Yang et al.

(10) Patent No.: US 7,736,172 B2
(45) Date of Patent: Jun. 15, 2010

(54) CABLE ASSEMBLY

(75) Inventors: Guo-Hua Yang, Kunshan (CN); David Ko, Fullerton, CA (US); Su-Feng Liu, Kunshan (CN)

(73) Assignee: Hon Hai Precision Inc. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/319,297

(22) Filed: Jan. 5, 2009

(65) Prior Publication Data

US 2009/0176403 A1 Jul. 9, 2009

(30) Foreign Application Priority Data

Jan. 5, 2008 (CN) ..... 2008 2 0030612 U

(51) Int. Cl.
*H01R 13/627* (2006.01)

(52) U.S. Cl. ..... 439/358; 439/607.49; 439/77

(58) Field of Classification Search ..... 439/358, 439/495, 77, 607.49, 607.56
See application file for complete search history.

(56) References Cited

U.S. PATENT DOCUMENTS 7,637,779 B2 * 12/2009 Nagata et al. ..... 439/607.49
2005/0255742 A1 11/2005 Shih
2006/0110970 A1 * 5/2006 Takaku et al. ..... 439/358
2006/0252296 A1 * 11/2006 Wu ..... 439/358
2008/0280479 A1 * 11/2008 Wu et al. ..... 439/358
2009/0035982 A1 * 2/2009 Chen et al. ..... 439/358

FOREIGN PATENT DOCUMENTS

CN 1722530 A 1/2006
CN 201029126 Y 2/2008

* cited by examiner

*Primary Examiner*—Hien Vu
(74) *Attorney, Agent, or Firm*—Wei Te Chung; Andrew C. Cheng; Ming Chieh Chang

(57) ABSTRACT

A cable assembly in accordance with the present invention comprises an insulative housing defining a supporting portion with an upper surface and a pair of fixing portions disposed at two sides of the supporting portion with a top surface higher than the upper surface, and a receiving space defined by the supporting portion and the pair of fixing portions; a flexible flat cable supported by the supporting portion of the insulative housing and received into the receiving space; an upper shell assembled to the insualtive housing and defining a main body portion covering to the flexible flat cable and a pair of positioning portions respectively attached to the pair fixing portions thereof, the upper shell having a recessed main body portion relative to the pair of fixing portions and received into the receiving space; and a pair of latch members respectively mounted on the pair of fixing portions.

11 Claims, 5 Drawing Sheets

CABLE ASSEMBLY

FIELD OF THE INVENTION

The present invention relates to a cable assembly, and more particularly to a cable assembly with a shell securely assembled to an insulative housing thereof and not easily to be divorced from the insulative housing.

DESCRIPTION OF PRIOR ART

U.S. Pat. Pub. No. US2005/0255742 A1 filed by Shih (hereinafter referred to as Shih '742 Pat. Pub.) on Nov. 17, 2005 discloses a cable assembly 1. Please referring to FIGS. 3 through 7 of the Shih '742 Pat. Pub., it includes a connector housing 10, a flat cable 40 preinstalled on the connector housing 10, a shell 30 covered to the connector housing 10 and compressed the flat cable 40 and a pair of spring clamp 20 mounted on two sides of the connector housing 10. The shell 30 defines several tabs (not labeled) at two sides thereof and respectively attached to the two sides of the connector housing 10. When the cable assembly 1 is in the process of plugging into and pulling out from the complementary connector (not shown), the operator should press the spring clamp 22 inwardly making the spring clamp 22 swung relative to the connector housing 10, at the same time the tabs of the shell 30 will be forced by the spring clamp 22. Thus, the middle portion of the shell 30 will be expanded outwardly and spaced to connector housing 10, so that the shell 30 may be divorced from the connector housing 10 when the spring clamps 22 act on the tabs of the shell 30 by a comparably large inward pressure.

As discussed above, an improved cable assembly overcoming the shortages of existing technology is needed.

SUMMARY OF THE INVENTION

Accordingly, an object of the present invention is to provide a cable assembly with a shell firmly assembled to the insulative housing and not easily to be separated from the insulative housing.

In order to achieve the above-mentioned objects, a cable assembly in accordance with the present invention comprises an insulative housing defining a supporting portion with an upper surface and a pair of fixing portions disposed at two sides of the supporting portion with a top surface higher than the upper surface, and a receiving space defined by the supporting portion and the pair of fixing portions; a flexible flat cable supported by the supporting portion of the insulative housing and received into the receiving space; an upper shell assembled to the insualtive housing and defining a main body portion covering to the flexible flat cable and a pair of positioning portions respectively attached to the pair fixing portions thereof, the upper shell having a recessed main body portion relative to the pair of fixing portions and received into the receiving space; and a pair of latch members respectively mounted on the pair of fixing portions.

Other objects, features and advantages of the invention will be apparent from the following detailed description taken in connection with the accompanying drawings.

DETAILED DESCRIPTION OF PREFERRED EMBODIMENTS

Figure 1:
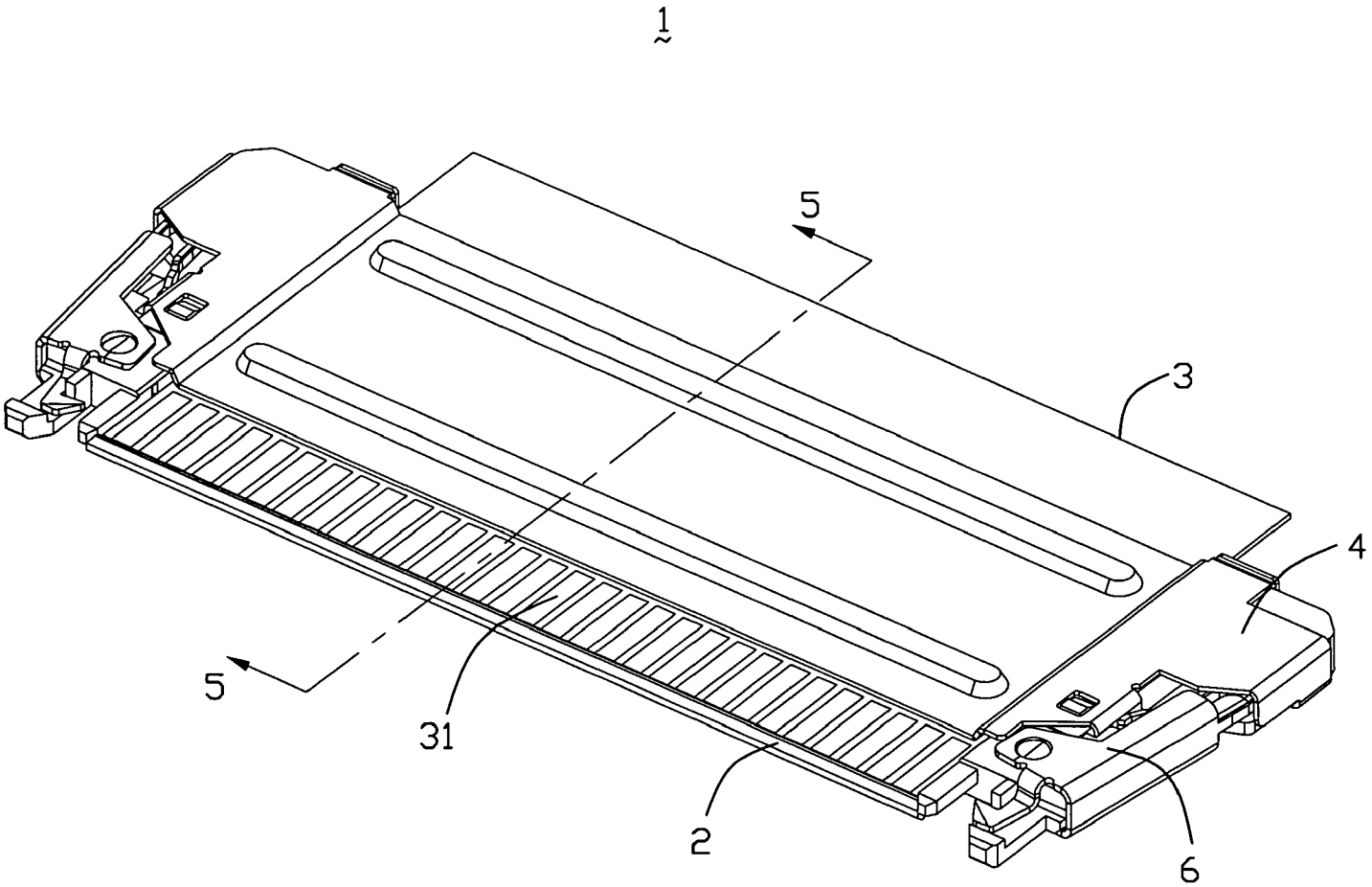
FIG. 1 is a perspective view of a cable assembly in accordance with the present invention.

Reference will now be made to the drawing figures to describe the present invention in detail.

Figure 2:
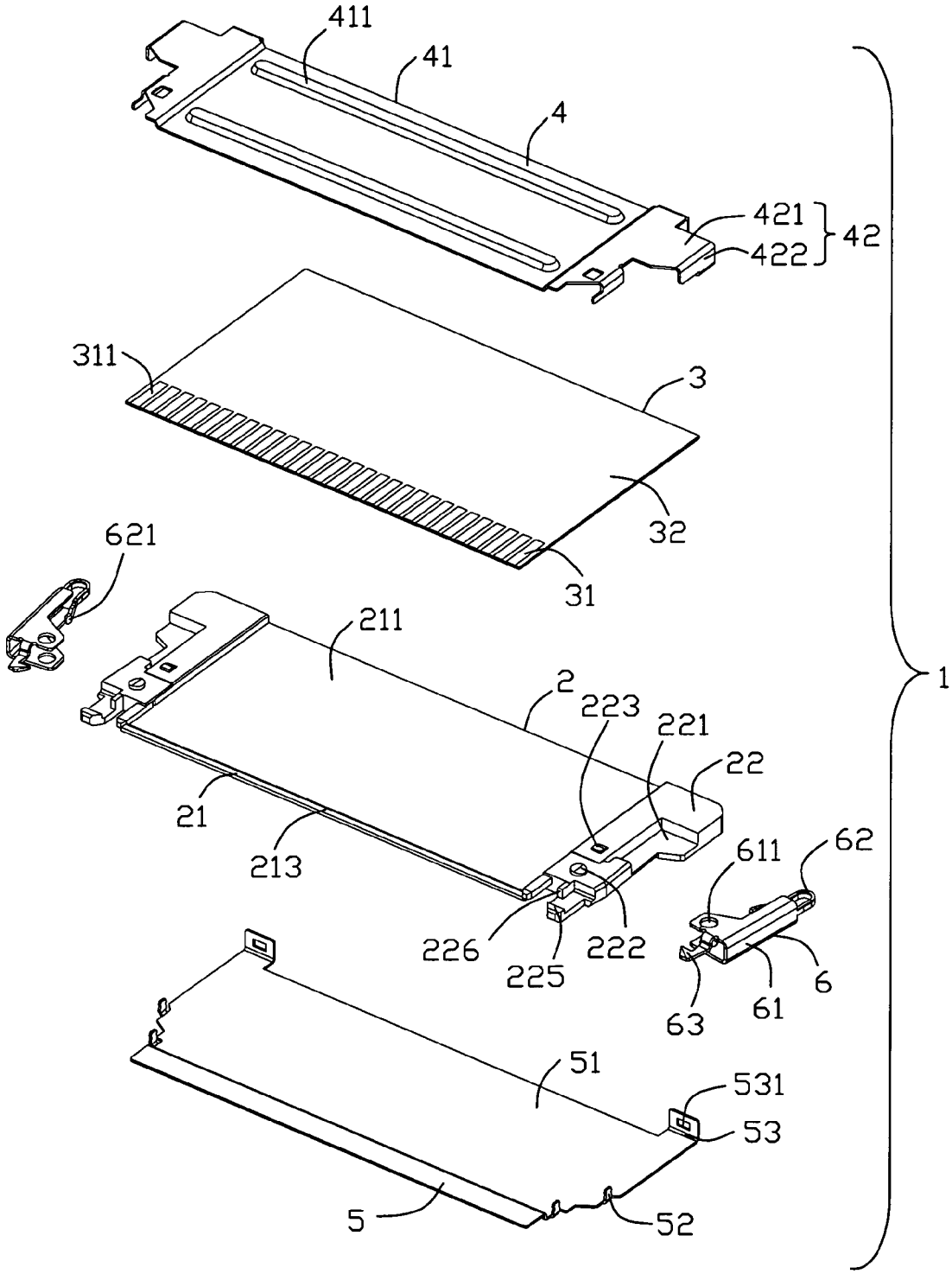
FIG. 2 is an exploded, perspective view of the cable assembly.
Figure 3:
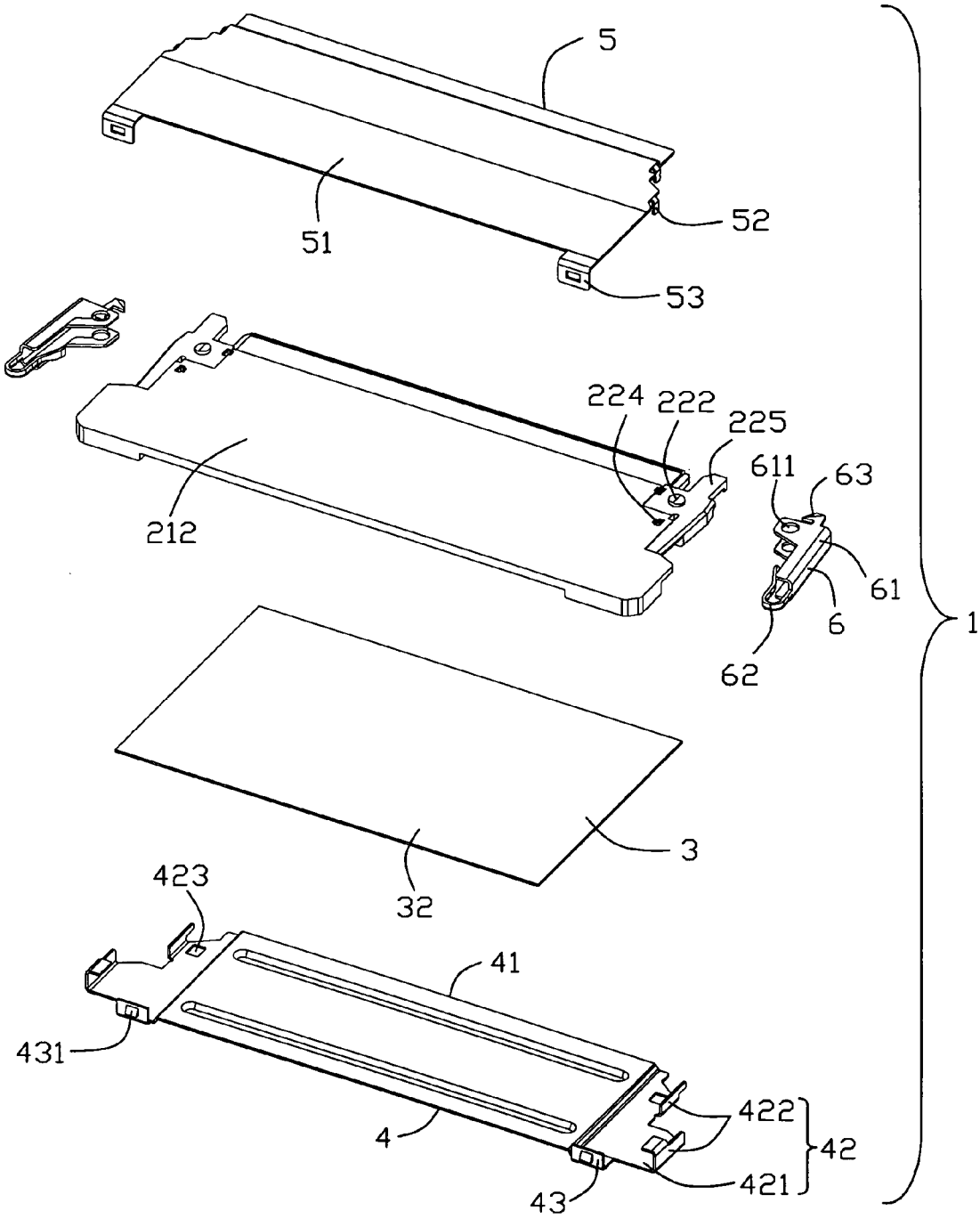
FIG. 3 is an exploded, perspective view of the cable assembly in another point of view different from FIG. 2.
Figure 4:
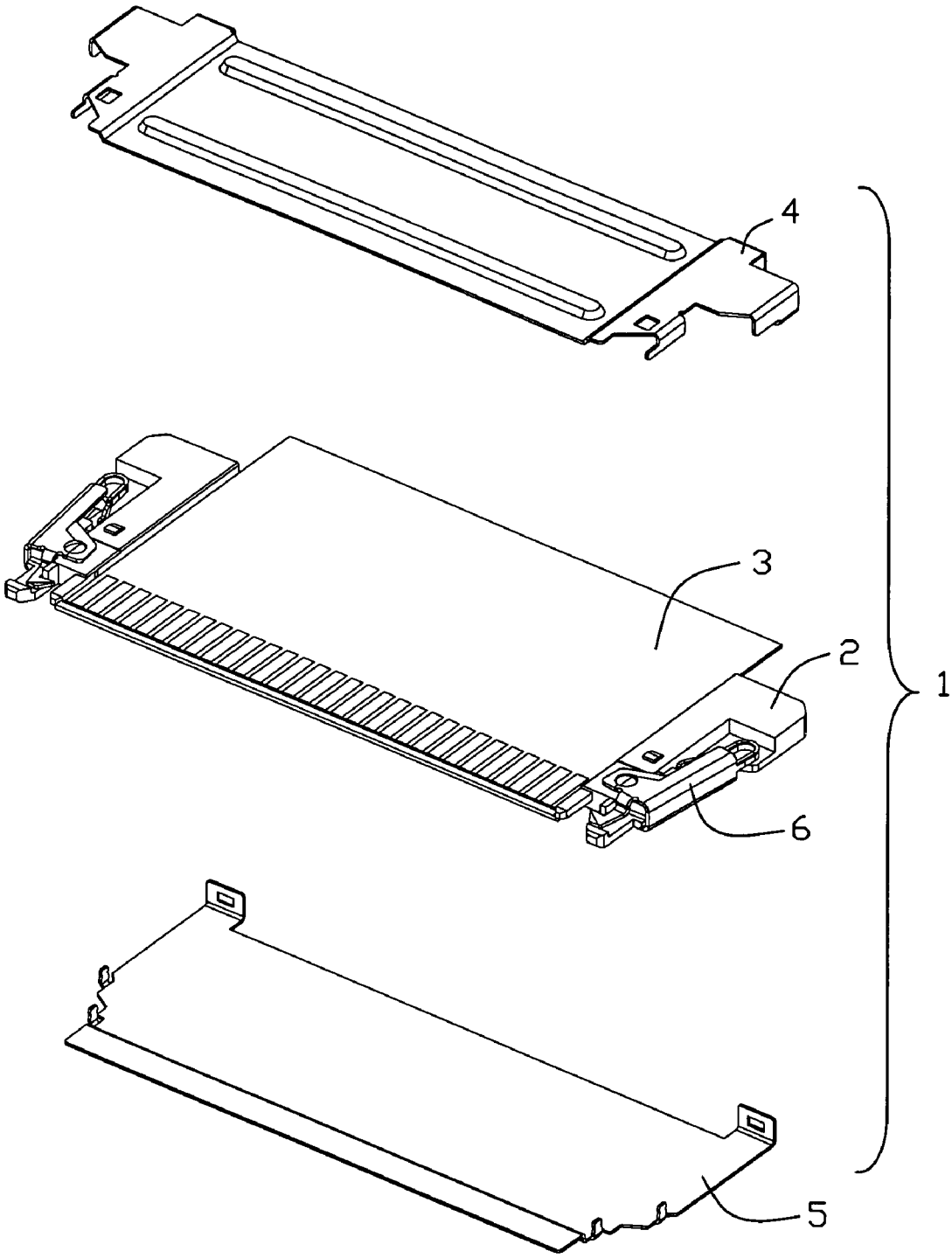
FIG. 4 is a partial perspective view of the cable assembly made in accordance with the present invention.
Figure 5:
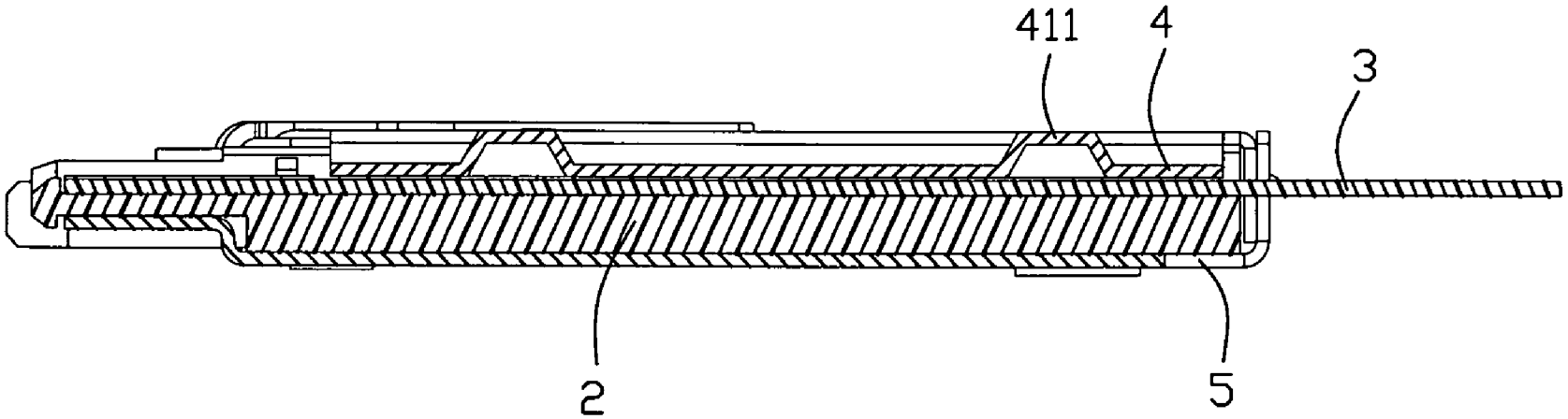
FIG. 5 is a cross section view of the cable assembly of FIG. 1 taken along line 5-5.

Referring to FIGS. 1 to 3, a cable assembly 1 in accordance with the present invention includes an insulative housing 2, a flexible flat cable 3 supported by the insualtive housing 2, an upper and a lower shell 4, 5 respectively assembled to the insulative housing 2 and a pair of latch members 6 respectively assembled to the two sides of the insulative housing 2.

Referring to FIGS. 1 to 5, the insulative housing 2 includes a supporting portion 21 for supporting the flexible flat cable 3 and a pair of fixing portions 22 disposed at two sides thereof for mounting the two latch members 6 thereon. The supporting portion 21 defines an upper surface 211 for attaching the flexible flat cable 3 and a lower surface 212 opposite to the upper surface 21. A lengthwise rib 213 is formed at the front end of the supporting portion 21 extending upwardly from the upper surface 211. Thus, the flexible flat cable 3 is stopped by the rib 213 which is moved from back to front. Each fixing portion 22 defines a L-shaped groove 221 recessed from a top surface and a side surface thereof, a pair of retaining posts 222 respectively formed on the top and bottom surface of the fixing portion 22 for mounting the latch member 6, a wedge-shaped block 223 defined on the top surface thereof and two spaced positioning slots 224 formed on the bottom surface thereof for positioning the lower shell 5. A guide rod 225 extends forwardly from the fixing portion 22 defining a block 226 extending upwardly thereon for preventing the latch member 6 swung inwardly. The upper surface 211 of the supporting portion 21 is lower than the top surface of the fixing portion 22 so that a receiving space is defined therebetween.

The flexible flat cable 3 defines a top and a bottom insulative layer 32, and a plurality of conductors 31 enveloped by the top and bottom insulative layer 32. The mating portions 311 of the conductors 31 are exposed out of the top insualtive layer 32 and can be mating with the terminals (not shown) in the complementary connector.

The upper and lower shell 4, 5 can be respectively stamped from a metal plate and covered to the insulative housing 2.

The upper shell 4 includes a main body portion 41, a pair of positioning portions 42 and a pair of engaging portions 43. The main body portion 41 defines two flanges 411 protruding upwardly and extending in a widthwise direction and attached to the flexible flat cable 3. The pair of positioning portions 42 extend upwardly and outwardly in turn from both sides of the main body portion 41 making the main body portion 41 lower than the two positioning portions 42. The positioning portion 42 of the upper shell 4 surrounded the fixing portion 22 defines a L-shaped horizontal portion 421 and two spaced tabs 422 bent downwardly from the side edge of the horizontal portion 421. The horizontal portion 421 of the positioning portion 42 is attached to the top surface of the fixing portion 22, defines a retaining hole 423 matched with the wedge-shaped block 223 of the fixing portion 22. The two spaced tabs 422 are also fitted around the fixing portion 22. The pair of engaging portions 43 extending downwardly from rear edge of the positioning portions 42 defines an emboss 431 thereon for engaging with the lower shell 5.

The lower shell 5 defines a base portion 51, four tabs 52 extending upwardly from both sides of the body portion 51 and a pair of latch portions 53 extending upwardly from two sides of the rear edge. The tabs 52 are received into the positioning slots 224 of the insulative housing 2 making the lower shell 5 engaged with the insulative housing 2. The latching portions 53 defines a hole 531 matched with the emboss 431 of the engaging portions 43.

The latch member 6 is stamped from a metal plate and assembled to the fixing portioin 22 of the insulative housing 2. The latch member 6 defines a operating portion 61, a resilient portion 62 extending rearwardly firstly and then turning back for a distance and a locking barb 63 extending forwardly from pressing 61 for latching with the complementary connector. The cross section of the operating portion 61 is generally U-shaped defining an opening toward to the side surface fixing portion 22. The operating portion 61 defines a top wall, a bottom wall and a side wall connected with the top wall and the bottom wall. Each top wall and bottom wall defines a hole 611 fitted with the corresponding retaining post 222 of the fixing portion 22. The slender resilient portion 62 is received into the L-shaped groove 221 and defines a distal portion 621 attched to the tabs 422 of the upper shell 4.

Referring to FIGS. 1 to 5, the assembling process of the cable assembly 1 in according to the present invention starts from assembling the flexible flat cable 3 on the upper surface 211 of the supporting portion 21 of the insulative housing 2 and making them engaged with each other by glue.

After the flexible flat cable 3 is assembled to the insulative housing 21, then assembling the upper shell 4 to the insulative housing 2. The main body portion 41 of the upper shell 4 is attached to the flexible flat cable 3 and received into the receiving space formed between the supporting portion 21 and the fixing portion 22. And the mating portions 311 of the conductors 31 of the flexible flat cable 3 are exposed out of the upper shell 4. The two positioning portions 42 of the upper shell 4 are fitted around a section of the fixing portion 22 of the insulative housing 2 and defines a retaining hole 423 engaged with the wedge-shaped block 223 of the fixing portion 22 making the upper shell 4 positioned to the insulative housing 2. The engaging portion 43 is attached to the rear surface of the fixing portion 22.

After the upper shell 4 is assembled to the insulative housing 21, then assembling the lower shell 5 to the insulative housing 2. Several tabs 52 of the lower shell 5 are received into the positioning slots 224 and making the lower shell 5 engaged with the insulative housing 21. The hole 531 of the latch portion 53 matched with the emboss 431 of the engaging portions 43 so that the upper shell 4 and the lower shell 5 are engaged with each other.

At last, assembling the pair of latch members 6 to the fixing portion 22 of the insulative housing 2. The hole 611 of the operating portion 61 is fitted with the retaining post 222 of the fixing portion 22 allowing the latch member 6 angular swung such that the operating portion 61 of the latch member 6 is mounted to the fixing portion 22. The resilient portion 62 is received into the L-shaped groove 221 and making the distal portion 621 thereof attached to the tabs 422 of the upper shell 4.

After the above assembling steps, the entire process of assembling the cable assembly 1 is finished.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What we claimed is:

1. A cable assembly, comprising:

an insulative housing defining a supporting portion with an upper surface and a pair of fixing portions disposed at two sides of the supporting portion with a top surface higher than the upper surface, and a receiving space defined by the supporting portion and the pair of fixing portions;

a flexible flat cable supported by the supporting portion of the insulative housing and received into the receiving space;

an upper conductive shell assembled to the insulative housing and defining a main body portion covering to the flexible flat cable and a pair of positioning portions respectively attached to the pair fixing portions thereof, the upper conductive shell having a recessed main body portion relative to the pair of fixing portions and received into the receiving space;

a pair of latch members respectively mounted on the pair of fixing portions;

wherein the pair of positioning portions of the upper shell are both bent upwardly and outwardly from two sides of the main body portion;

wherein each positioning portion comprises an L-shaped horizontal portion defining retaining hole and two spaced tabs bent downwardly from the side edge of the L-shaped horizontal portion;

wherein each fixing portion defines a wedge-shaped block thereon received in the retaining hole, a pair of upright retaining posts respectively formed on the top and bottom surface thereof and a L-shaped groove recessed from the top surface and side surface thereof receiving in each of the latch members;

wherein each latch defines a operating portion having a pair of holes corresponding to the pair of retaining posts, a resilient portion extending rearwardly and bending backward for a distance for receiving in the L-shape groove, and a locking barb extending forwardly from operating portion; and wherein a lengthwise rib is formed at the front end of the supporting portion protruding upwardly and extending along a transverse direction for stopping the flexible flat cable moved forwardly.

2. The cable assembly as recited in claim 1, wherein the cable assembly further defines a lower shell assemble to the insulative housing and engaged with the upper shell.

3. The cable assembly as recited in claim 2, wherein the lower shell defines a plurality of tabs disposed at two sides thereof and a pair of latch portion disposed at two sides of the rear edge thereof.

4. The cable assembly as recited in claim 3, wherein the insulative housing defines a plurality of positioning slots receiving the corresponding tabs of the lower shell.

5. The cable assembly as recited in claim 3, wherein the upper shell further defines a pair of engaging portions extending downwardly from rear edge of the positioning portions engaged with the pair of latch portion.

6. The cable assembly as recited in claim 1, wherein the flexible flat cable is attached to the supporting portion of the insulative housing by glue.

7. The cable assembly as recited in claim 1, wherein the flexible flat cable defines a top insulative layer, a bottom insulative layer and a plurality of conductors enveloped by the top and bottom insulative layer.

8. The cable assembly as recited in claim 7, wherein each conductor defnes a mating portion exposed out of the top insualtive layer.

9. The cable assembly as recited in claim 1, wherein the main body portion of the upper shell defines two flanges protruding upwardly and extending in a widthwise direction.

10. A cable connector assembly comprising:

an insulative housing defining a longitudinal rib at a front end of a transverse middle supporting portion and a pair of fixing portions raised upwardly with regard to the supporting portion; a flexible flat cable (FFC) positioned upon an upper surface of the supporting portion and being stopped moving forwardly by the longitudinal rib; an upper conductive shell defining a middle main portion seated upon the FFC so as to cooperate with the supporting portion to sandwich said FFC therebetween, and a pair of positioning portions raised upwardly with regard to the middle main portion and securely seated upon the pair of fixing portions of the housing, respectively;

a bottom conductive shell defining a base portion directly abutting against an undersurface of the supporting portion; wherein the base portion includes a front section upwardly offset from remainders and received in a recess formed in a front area of said undersurface of the supporting portion;

wherein a pair of latches pivotally mounted upon the pair of fixing portions;

wherein each positioning portion comprises an L-shaped horizontal portion defining retaining hole and two spaced tabs bent downwardly from the side edge of the L-shaped horizontal portion;

wherein each fixing portion defines a wedge-shaped block thereon received in the retaining hole, a pair of upright retaining posts respectively formed on the top and bottom surface thereof and a L-shaped groove recessed from the top surface and side surface thereof receiving in each of the latches;

wherein each latch defines a operating portion having a pair of holes corresponding to the pair of retaining posts, a resilient portion extending rearward and bending backward for a distance for receiving in the L-shape groove, and a locking barb extending forwardly from operating portion.

11. The cable connector assembly as claimed in claim 10, wherein each of said pair of latches defines a structure sandwiching the corresponding fixing portion therebetween in an up-and-down direction.

* * * * *